US005931023A

United States Patent [19]

Brach et al.

[11] Patent Number: 5,931,023

[45] Date of Patent: Aug. 3, 1999

[54] PROCESS AND APPARATUS FOR KNITTING FABRIC WITH NON-ELASTIC YARN AND BARE ELASTOMERIC YARN AND SWEATER KNIT FABRIC CONSTRUCTION

[76] Inventors: Ernesto Brach, 123 Division Ave., Apartment 1A, Brooklyn, N.Y. 11211; Isaac Brach, 1240 53rd St., Brooklyn, N.Y. 11219

[21] Appl. No.: 08/728,110

[22] Filed: Oct. 9, 1996

Related U.S. Application Data

[63] Continuation-in-part of application No. 08/561,307, Nov. 21, 1995

[60] Provisional application No. 60/015,065, Apr. 9, 1996, and provisional application No. 60/005,220, Oct. 12, 1995.

[51] Int. Cl.[6] ..... D04B 15/46

[52] U.S. Cl. ..... 66/136; 66/146; 66/175; 66/125 R

[58] Field of Search ..... 66/125 R, 64, 66/136, 132 R, 146, 169, 170, 171, 175

[56] References Cited

U.S. PATENT DOCUMENTS

| | | | |
|---|---|---|---|
| 3,800,564 | 4/1974 | Carswell | 66/146 X |
| 3,971,234 | 7/1976 | Taylor . | |
| 4,062,204 | 12/1977 | Segundo et al. | 66/196 |
| 4,706,476 | 11/1987 | Memminger et al. | 66/146 X |
| 4,752,044 | 6/1988 | Memminger et al. | 242/47.01 |
| 4,953,367 | 9/1990 | Memminger et al. | 66/132 R |
| 4,977,758 | 12/1990 | Miur | 66/132 R X |
| 5,063,756 | 11/1991 | Rikiishi | 66/132 R |
| 5,280,713 | 1/1994 | Hansen et al. | 66/146 |
| 5,323,625 | 6/1994 | Paggario | 66/146 |
| 5,331,564 | 7/1994 | Barea | 6/132 R X |
| 5,423,197 | 6/1995 | Roser | 66/132 R |
| 5,513,503 | 5/1996 | Gray et al. | 66/125 R |
| 5,640,858 | 6/1997 | Komenda | 66/64 X |

FOREIGN PATENT DOCUMENTS

| | | |
|---|---|---|
| 0 499 380 A1 | 8/1992 | European Pat. Off. . |
| 1 812 285 | 7/1969 | Germany . |
| 0 11 9 536 A1 | 9/1984 | Germany . |
| 43 08 663 A1 | 9/1994 | Germany . |
| 529561 | 11/1940 | United Kingdom . |
| 540964 | 11/1941 | United Kingdom . |
| 1146726 | 3/1969 | United Kingdom . |
| 1293637 | 10/1972 | United Kingdom . |
| WO 94/12711 | 6/1994 | WIPO . |
| WO 94/24352 | 10/1994 | WIPO . |

OTHER PUBLICATIONS

Technical Information Brochure—"Lycra Spandex in Circular Knit Fabrics"—DuPont Bulletin L—87, Nov.,1977 Boulder.

Technical Information Brochure—"Electronic Yarn Feeder", EFS 21,22,31 and 32—Memminger—IRO GmbH, No Date Given.

*Primary Examiner*—John J. Calvert
*Assistant Examiner*—Larry D. Worrell, Jr.
*Attorney, Agent, or Firm*—George A. Frank; Jeffrey M. Kaden

[57] ABSTRACT

A sweater knit fabric containing hard yarn plaited together with bare elastomeric yarn is provided. The elastomeric yarn has substantially uniform draft along each course in the fabric. The fabric is made by a process in which the bare elastomeric yarn is fed under substantially uniform tension to a knitting machine in which yarn demand fluctuates as the fabric is knitted. Sweater knit fabrics are useful in making garments such as sweaters, vests, dresses, pants, skirts, shirts and caps.

29 Claims, 8 Drawing Sheets

SPANDEX DRAFT ALONG COURSE

PROCESS AND APPARATUS FOR KNITTING FABRIC WITH NON-ELASTIC YARN AND BARE ELASTOMERIC YARN AND SWEATER KNIT FABRIC CONSTRUCTION

CROSS-REFERENCE TO RELATED APPLICATIONS

This application is a continuation-in-part of Ser. No. 08/561,307, filed Nov. 21, 1995, pending, and benefit of Provisional Application 60/015,065, filed Apr. 9, 1996 and Provisional Application 60/005,220, filed Oct. 12, 1995 is claimed.

BACKGROUND OF THE INVENTION

This invention relates to fabric knit from non-elastic yarns and elastic yarns. More particularly, it relates to sweater knit fabric made from hard yarn plaited with bare elastomeric yarn.

Knit fabrics constructed by plaiting hard yarns, such as nylon, wool, cotton and polyester, with processed elastomeric yarns, such as core spun elastomeric yarn, covered elastomeric yarn, or taslanized elastomeric yarn, are well known. Such fabrics are typically prepared by either knitting the two yarns together, or by plaiting the elastomeric yarn and the knitted structure formed by the hard yarn. Processed elastomeric yarns are less than desirable for use in sweater and other knit outerwear since they are expensive to prepare and involve difficulties in subsequent garment manufacture, such as color grin-through, irregular stitch formation, and excessive weight.

Knit fabrics constructed by plaiting hard yarn with bare elastomeric yarn, such as spandex, are known, and overcome some of the above problems. However, such constructions, when knit by known prior art methods, result in knit fabrics that exhibit a number of undesirable conditions, such as broken spandex filaments, barre', unequal selvedge lengths, and stitch jamming. This, in turn, results in lower quality knit fabric and waste. Moreover, any variation in the speed of the fed spandex yarn will induce variation in both spandex yarn tension and draft, resulting in changes in dimension of the finished garment blank.

In European Publication No. 0119536 owned by Bayer AG of Germany, there is described a method of knitting together spandex yarn with hard yarn in which the feeding of spandex yarn is controlled by means of a friction based tension device, which operates to frictionally restrain the fed spandex yarn. The method described in this publication is disadvantageous because tension of the fed yarn is extremely difficult to control uniformly—the yarn is intermittently grabbed and released as it is being fed for knitting. This leads to uneven and irregular loop formation and fabric width in the end product that is produced by this method.

Accordingly, it would be desirable to provide a method and system which overcomes the disadvantages found in the prior art.

SUMMARY OF THE INVENTION

The present invention provides a sweater knit fabric comprising at least one hard yarn and at least one bare elastomeric yarn, the yarns being plaited together into a sweater knit fabric, wherein the elastomeric yarn has substantially uniform draft along each course in the fabric.

Further, the present invention provides a method for constructing a sweater knit fabric comprising:

delivering at least one bare elastomeric yarn and at least one hard yarn to a common location for knitting;

knitting together the two yarns in a plaited formation in order to produce a sweater knit fabric;

selecting a desired level of tension for the elastomeric yarn as the yarn is delivered for knitting; and maintaining said desired tension level substantially constant during said knitting such that the tension of the elastomeric yarn during steady state knitting varies no more than 17% from the average total steady state tension of said yarn.

Further still, the present invention provides a system for constructing sweater knit fabrics by plaiting together at least one hard yarn and at least one bare elastomeric yarn comprising:

means for knitting together at least one elastomeric yarn and at least one hard yarn in a plaited formation in order to produce a sweater knit fabric;

means for delivering said elastomeric yarn to said knitting means;

means for delivering said hard yarn to the knitting means;

means for selecting a desired level of tension for the elastomeric yarn as the yarn is delivered to said knitting means; and means for maintaining said desired tension level substantially constant during knitting such that the tension of the elastomeric yarn during steady state knitting varies by no more than 17% from the average total steady state tension of said yarn.

DETAILED DESCRIPTION OF THE INVENTION

Figure 1:
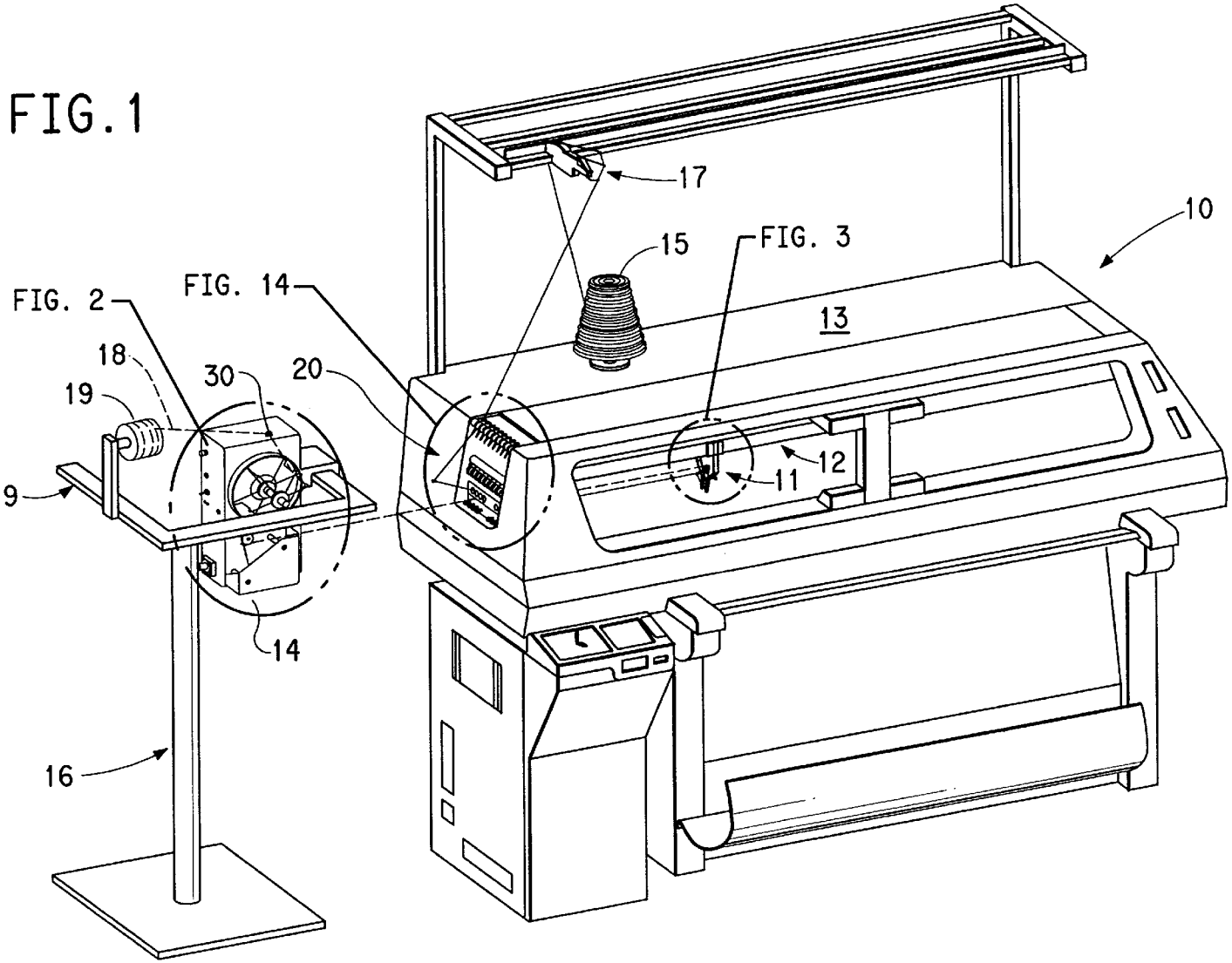
FIG. 1 is a perspective view of a system useful in practicing the invention, including a spandex feeder in operation with a knitting machine.

Generally speaking, the present invention provides a sweater knit fabric that has substantially uniform draft in spite of intermittent or fluctuating demand for yarn during the knitting process. The invention also provides a method and apparatus for making such sweater knit fabric by feeding bare elastomeric yarn to a knitting machine under substantially uniform tension.

For purposes of this invention, "sweater knit fabric" is a fabric that is knitted on a circular strip knitting machine or a flat strip knitting machine. These strip knitting machines insert a separating thread between knitted strips and/or knit a finished edge, for example a waistband or a cuff, at the beginning of the sweater strip. The finished edge generally has a different stitch construction than the rest of the strip. In said strip knitting machines, the demand for yarn, including bare elastomeric yarn, is intermittent or fluctuates, regardless of whether the machine is automatically controlled (for example, mechanically or electronically controlled) or manually controlled. Intermittent demand results from the periodic reversal of the yarn carrier in flat knitting and from the cross-over from one strip to another in circular knitting. Fluctuating demand results from changes in stitch construction, which may be between courses, as in the change between the body of the strip and the finished edge, or within a course, as in an alternating rib/jersey stitch construction. Sweater knit fabrics can be used in various garments including, but not limited to, sweaters, vests, dresses, pants, shirts, skirts and caps.

Precise and uniform control of draft (elongation) of elastomeric yarn when knitting a sweater knit fabric is critical to overcoming the problems noted hereinabove. This is particularly important when the yarn draft is modest, for example, less than 4.5 stretch (350% elongation) average along a course of loops in the fabric. This is because elastomeric yarn having low draft will exhibit noticeable dimensional differences or inconsistencies if the yarn tension varies as it is fed to the knitting machine.

When the yarn tension is maintained substantially constant during knitting, the yarn feed rate matches momentary demand for the elastomeric yarn by the knitting machine and substantially uniform draft along the elastomeric yarn can be achieved. Substantially constant tension levels can be achieved during knitting by monitoring yarn tension and adjusting the feed rate accordingly, and by removing or reducing sources of friction applied to the elastomeric yarn as it is fed into the knitting machine.

Bare spandex is the preferred elastomeric yarn to be used in the inventive method and product. Bare spandex is known to have a high coefficient of friction and is defined as a manufactured filament fiber in which the fiber-forming substance is a long chain synthetic polymer composed of at least 85% by weight of a segmented polyurethane. It will be apparent, however, that the product and process of the present invention can incorporate and use any elastomeric fiber, such as rubber or polyetherester fiber, which has properties suitable for sweater knit fabrics and knitting such fabrics.

The bare elastomeric yarn has an average draft along a knit course of preferably less than 4.5× stretch (350% elongation), more preferably 1.1× to 4.5× stretch (10% to 350% elongation) and most preferably 1.2× to 2.5× stretch (20% to 150% elongation). The draft of the bare elastomeric yarn is substantially uniform along each course in the sweater knit fabric. That is, said draft varies by less than about 10% from one side of the fabric to the other along the course. Additionally, it is desirable for the draft of the bare elastomeric yarn to be substantially uniform in successive courses in the fabric. In other words, it is desirable for the draft of each course to vary by 8% or less from the draft of every other course in the fabric. Most preferably, the variation in said draft is less than 5.5% both along each course and in successive courses.

Bare elastomeric yarn having a denier between 10 and 150 is advantageous for this invention. Bare elastomeric yarn having a denier between about 10 and 70 is more advantageous.

Controlling the tension level of the elastomeric yarn such that the yarn feed rate matches the demand for said yarn in the knitting machine is accomplished by using a process and feeding apparatus that supplies the yarn uniformly while compensating for intermittent demand or fluctuations in demand.

The tension level of the elastomeric yarn can be controlled in flat and circular strip knitting, in part, by incorporating into the yarn delivery apparatus a means for sensing momentary variations in demand for the elastomeric yarn and a means responsive to the sensing means for controlling any variation in the tension level of the elastomeric yarn as the tension level tries to vary in response to the variations in yarn demand.

Any mechanism capable of detecting variations in the tension of the elastomeric yarn can be used as the sensing means. Such mechanisms include optical, electronic, variable electrical resistance, mechanical and strain gauge (e.g. piezoelectric pressure (tension) sensing) devices. A movable mechanical control arm or a strain gauge device is preferred.

The sensing means can provide a signal to the drive mechanism of the yarn feeder indicating whether the feed rate of the elastomeric yarn needs to be adjusted. Alternatively, the sensing means can provide a signal to a device in the path of the yarn which can uptake yarn to increase the tension level.

Reducing friction along the yarn feed path of the knitting machine further enhances the uniformity of the elastomeric yarn feed. Such friction can be reduced by replacing as many stationary guides as possible with stationary guides having low friction surfaces such as ceramic, sapphire or ruby guides whose surfaces have been polished or with rotating guide members, preferably wheel guides rotating within jewel (e.g., sapphire) bearings. Reducing the size of the contact surface further reduces friction. For example, low friction surface guides with a contact point as small as 0.004 inches or less are advantageous. In addition, removing obstacles, including fixed guides, in the path of the elastomeric yarn can assist in reducing the need for such guiding members.

The process and apparatus of this invention maintains the tension level of the elastomeric yarn substantially constant such that the tension of the elastomeric yarn during steady state knitting varies by about 17% or less, preferably 10% or less, most preferably 6% or less, from the average total steady state tension of the yarn. Such control of the elastomeric yarn tension produces sweater knit fabric in which the elastomeric yarn has substantially uniform draft therealong, such that the fabric has substantially uniform stretch, recovery and weight per unit area.

For a fuller understanding of the invention, reference is made to the following description of preferred embodiments and the accompanying drawings depicting such embodiments.

Figure 2:
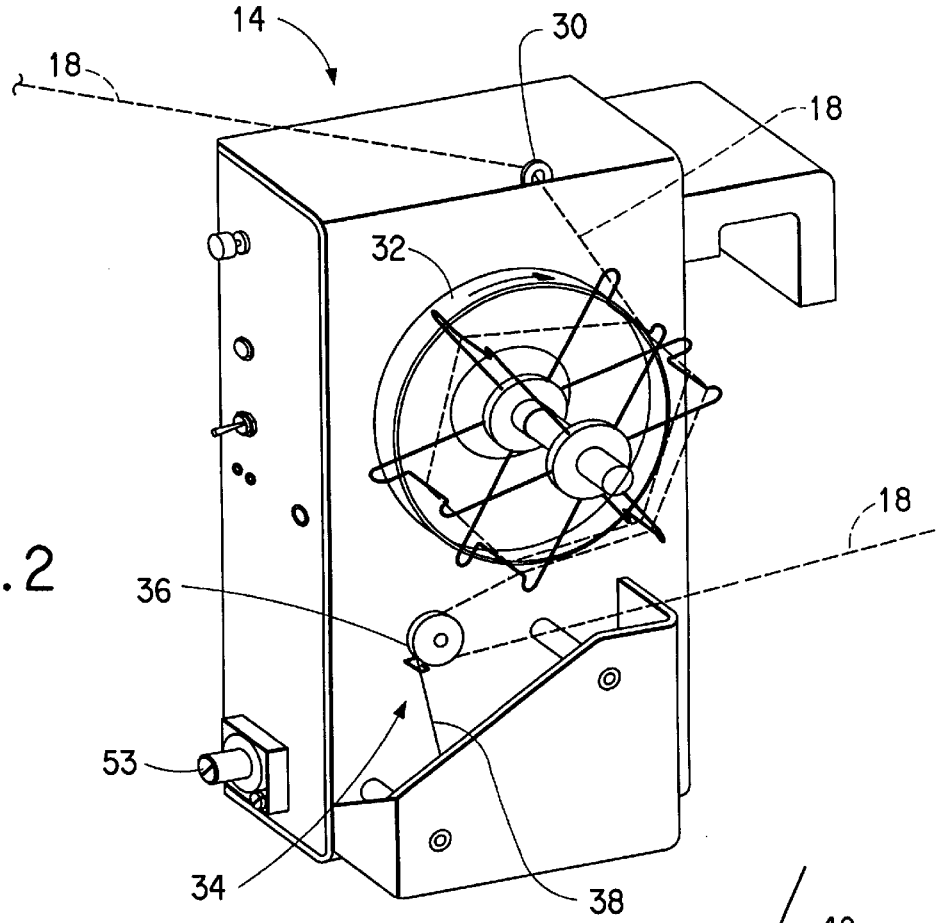
FIG. 2 is a perspective view of the modified spandex feeder depicted in FIG. 1.

The embodiment chosen for purposes of illustration, as shown in FIGS. 1–14, is a knitting system including a spandex or other elastomeric yarn supply unit 9, such as disclosed in U.S. Pat. No. 4,752,044, which is incorporated herein by reference, and a flat bed knitting machine, generally indicated at 10, for knitting with a hard yarn. As shown in FIG. 1, spandex supply unit 9 includes a spandex feeding device, generally indicated at 14, which is mounted on a stand 16. Spandex yarn 18 is fed from a spandex yarn package 19 into feeding device 14, which is intended to furnish yarn 18 to knitting machine 10 at a substantially uniform tension and draft. As best seen in FIG. 2, spandex yarn 18 is led through a ceramic eyelet 30 in order to guide the spandex across a stop-motion arm (not shown), which detects yarn breakage, and then onto a storage reel 32.

Feeding device 14 also includes a yarn tension sensor 34 and a guide roller 36, the latter over which yarn 18 travels from storage wheel 32, carrying one or more windings of spandex yarn 18, as it is led to knitting machine 10. Sensing is achieved by a control arm 38 on which is mounted roller 36. Control arm 38 can have its relative position vary, depending on the demand for spandex yarn 18 by the knitting machine. Control arm 38 is coupled to an internal motor (not shown) which operates and drives storage reel 32.

The desired yarn tension level is selected by setting yarn tension adjuster 53 of device 14. The tension level can be programmed to change during knitting, if desired, or to remain constant. When spandex demand increases, control arm 38 moves clockwise. This increases the speed of the internal motor, which in turn increases the rotational speed of storage reel 32 and therefore increases yarn feed rate. If spandex demand decreases, or stops entirely, the process is reversed, and control arm 38 moves counterclockwise until reel 32 slows or becomes stationary.

Knitting machine 10 (by way of example, Model SEC 202 sold by Shima Seiki of Wakayama, Japan) includes two needle beds, as is standard in the art of flat-bed knitting machines, and a cam box 12 which travels back and forth in order to knit horizontal rows of stitches. Cam box 12 drives a series of yarn carriers, generally indicated at 11 (see FIG. 3), for furnishing yarns to the knitting needles of machine 10, Knitting machine 10 also includes a stand plate 13 on which yarn cones 15 for supplying hard yarns are situated.

In particular, yarn cone 15 carries a hard yarn such as nylon, rayon, wool, or cotton. The yarn carried by cone 15 is unwound and travels through a standard tension device 17, as shown, which maintains the yarn under tension, and also acts as a stop motion, which activates if the yarn breaks. The hard yarn is then carried to a side tension device generally indicated at 20, and shown in the enlarged view of FIG. 14. Side tension device 20, as is known in the art, includes a plurality of tension device units 21 that are formed in rows for carrying a plurality of hard yarns therethrough. A multiple number of hard yarns 15 can travel through a corresponding ceramic eyelet 22 of its tension device unit 21, from which the yarn is guided into a corresponding eyelet 24 of device 20. The hard yarn runs through tension device 20 to both maintain the hard yarn under tension and to position the yarn appropriately as it is supplied to yarn carrier 11, as will later be described.

Figure 3:
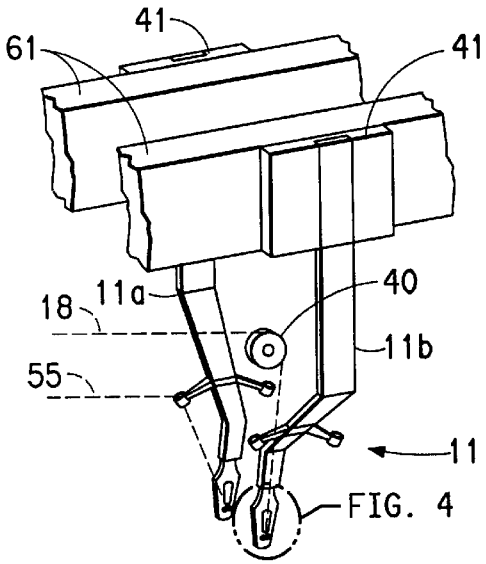
FIG. 3 is an enlarged perspective view of one embodiment of a yarn carrier assembly for practicing the invention.

Elastomeric yarn or spandex 18 passes from feeding device 14 (see FIGS. 1 and 2) directly over a corresponding wheel 29 and through a window 50 formed in cover 27. Wheel 29 is horizontally and vertically aligned with reel 32 of feeding device 14 (FIG. 2) and wheel 40 mounted on yarn carrier assembly 11 (FIG. 3). This substantially reduces the amount of frictional drag on spandex yarn 18 as yarn 18 is carried therealong.

Turning now to the yarn carrier assembly generally indicated at 11 and shown enlarged in FIG. 3, one yarn carrier 11A is used for carrying hard yarn 15, while a second yarn carrier 11B is used for carrying spandex yarn 18. Yarn carrier assembly 11 is attached to one or more yarn carrier blocks 41, which ride on rails 61.

Spandex yarn 18 comes in at an angle to the needle of the knitting machine, as compared to hard yarn 55, as shown in FIG. 3 and as is well known in the art of plaited knitting. Consequently, the spandex is placed at the back or behind the hard yarn when being knitted so that the spandex is hidden from view when a finished garment is prepared.

A second hard yarn may be integrally knit with the first hard yarn and the spandex by either utilizing a separate third yarn carrier, or by feeding the two hard yarns simultaneously through a single yarn carrier.

One of the important features of the system of this invention is the use of a series of low friction surfaces or wheels at various locations of the system for carrying the spandex. These are used in order to minimize as much as possible the amount of friction as the spandex yarn moves through the system. One reason the spandex yarn should be carried with a minimal amount of friction is so that spandex yarn can be knitted, if desired, under low tension with resulting low draft. If the spandex were knitted under high tension, a resulting sweater garment would have too much elasticity—in other words, the resulting garment would, in effect, act like a girdle and would constrain upon the body of the wearer. It would also make the garment heavier than desired.

There is another reason why it is important to ensure that the spandex is carried as friction-free as possible. If there were substantial friction, then the spandex would be knitted in an uneven and discontinuous fashion, especially when knitting at low tension, due to intermittent stretching of the spandex at each friction point. As a result, the final fabric product would contain stitch distortion, as well as horizontal lines, known as barre'.

A further reason for eliminating friction is to prevent, as much as possible, the breaking of the spandex yarn in the finished garment. Excess friction along the spandex yarn may overstress the yarn to a level where breakage can take place in the finished garment.

In the specific embodiment depicted in FIGS. 2, 3, 4 and 14, there are a series of rotatable wheels at numbers 29, 36, 40, 42, and 44. Enhancements and alternatives to this embodiment are shown in FIGS. 5–13. In FIG. 5, the yarn carrier assembly is generally indicated at 111 and includes an upper arm 113, a lower arm 115 pivotally connected to arm 113 by a pin assembly 117, and a yarn carrier tip 123. As illustrated in FIG. 5, elastomeric yarn 121 goes over a first guide wheel assembly 119 where it changes direction by a 90° angle. Guide wheel assembly 119 is mounted on upper arm 113 of yarn carrier assembly 111. Elastomeric yarn 121 continues to a second guide wheel assembly mounted within yarn carrier tip 123 and described below. There, the elastomeric yarn again changes direction by 90°, either to the left or to the right, depending on the directional traverse of the yarn carrier assembly of the system.

Figure 6:
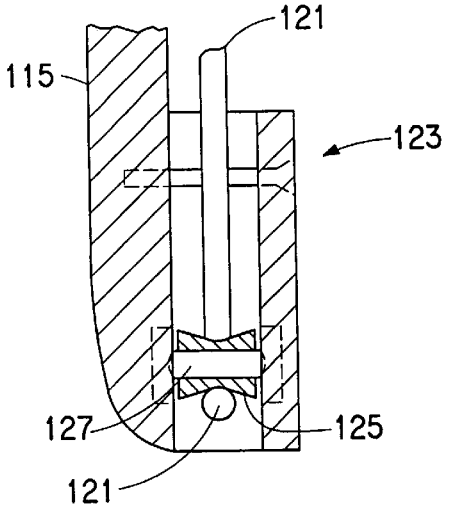
FIG. 6 is a cross-sectional view of the lower arm and yarn carrier tip of the yarn carrier assembly depicted in FIG. 5.
Figure 7:
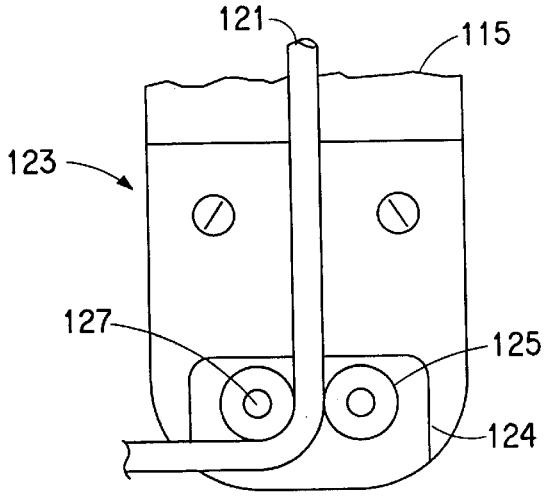
FIG. 7 is a front view of the yarn carrier tip and guide wheels depicted in FIG. 6.
Figure 8:
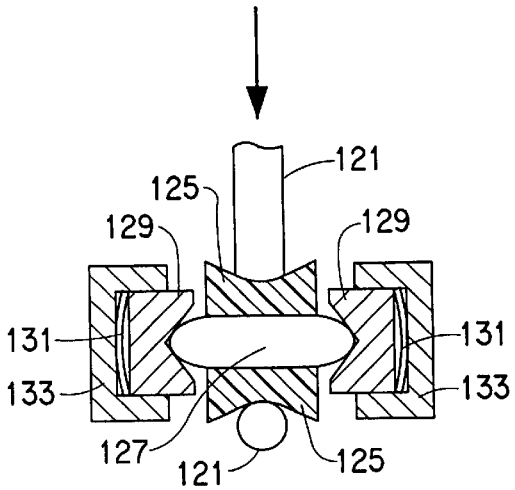
FIG. 8 is a cross-sectional view showing in more detail a first embodiment of the guide wheel assembly in the yarn carrier tip of FIGS. 5–7.

Focusing more closely on the lower arm 115 and yarn carrier tip 123, both FIGS. 6 and 7 show yarn 121 coming down between a pair of rotatable wheels 125, each of which is fixed to a corresponding shaft 127. As shown in FIG. 8, each wheel assembly of the yarn carrier tip includes steel shaft 127, a fixed mounted wheel 125, preferably made of brass, which rotates with the shaft, and a pair of jewel bearings 129 in which the pointed shaft ends nest. In the embodiment of FIG. 8, a flat spring 131 separates each jewel bearing from steel housing 133 of the wheel assembly. As a result, bearings 129 press up against the ends of steel shaft 127 embedded in wheel 125. Yarn 121, of course, travels over wheel 125, as shown.

Figure 9:
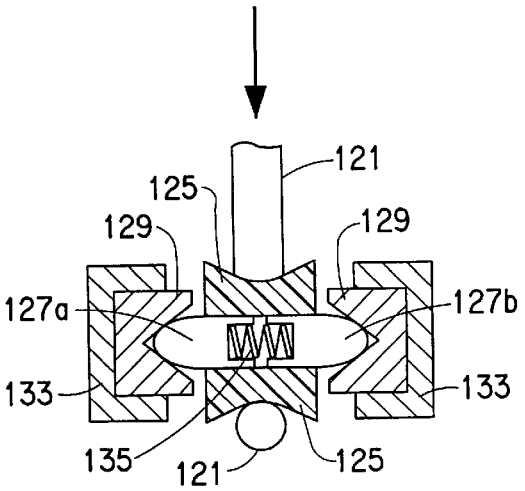
FIG. 9 is a cross-sectional view showing in more detail a second embodiment of the guide wheel assembly in the yarn carrier tip of FIGS. 5–7.
Figure 10:
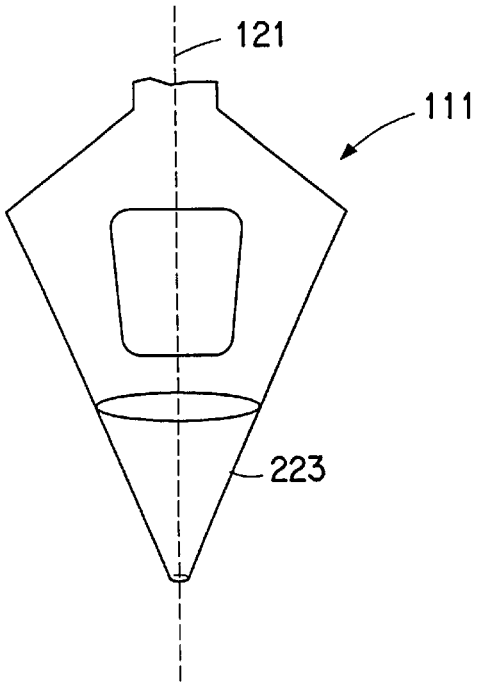
FIG. 10 is a front view of another embodiment of a yarn carrier tip for practicing the invention.
Figure 11:
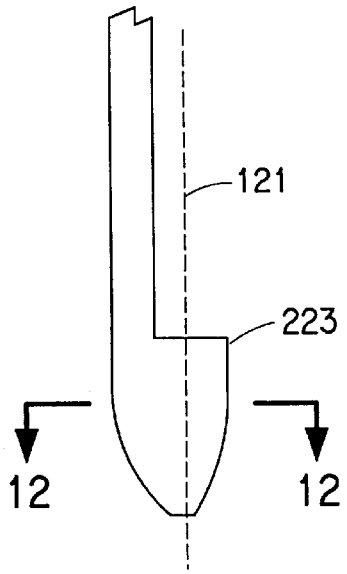
FIG. 11 is a side view of the yarn carrier tip of FIG. 10.

A second embodiment of each of wheel assemblies 124 is illustrated in FIG. 9. Instead of using flat springs to push the bearings against the pointed ends of the shaft, wheel assembly 124 includes a coiled spring 135 provided therein for pushing shaft elements 127*a* and 127*b* in opposite directions against jewel bearings 129.

Significantly, guide wheel assembly 119, generally illustrated in FIG. 5, is preferably constructed in accordance with either the embodiment shown in FIG. 8 or the embodiment shown in FIG. 9.

Figure 12:
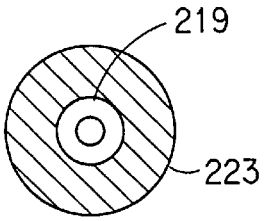
FIG. 12 is a cross-sectional view of the yarn carrier tip of FIG. 11 taken along line 12—12. This view shows the yarn carrier tip and the yarn guide situated within the tip.
Figure 13:
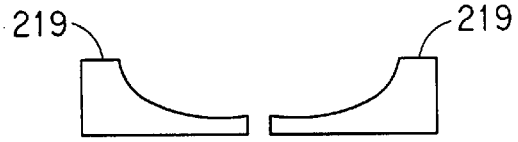
FIG. 13 is a cross-sectional view of the yarn guide of FIG. 12.
Figure 14:
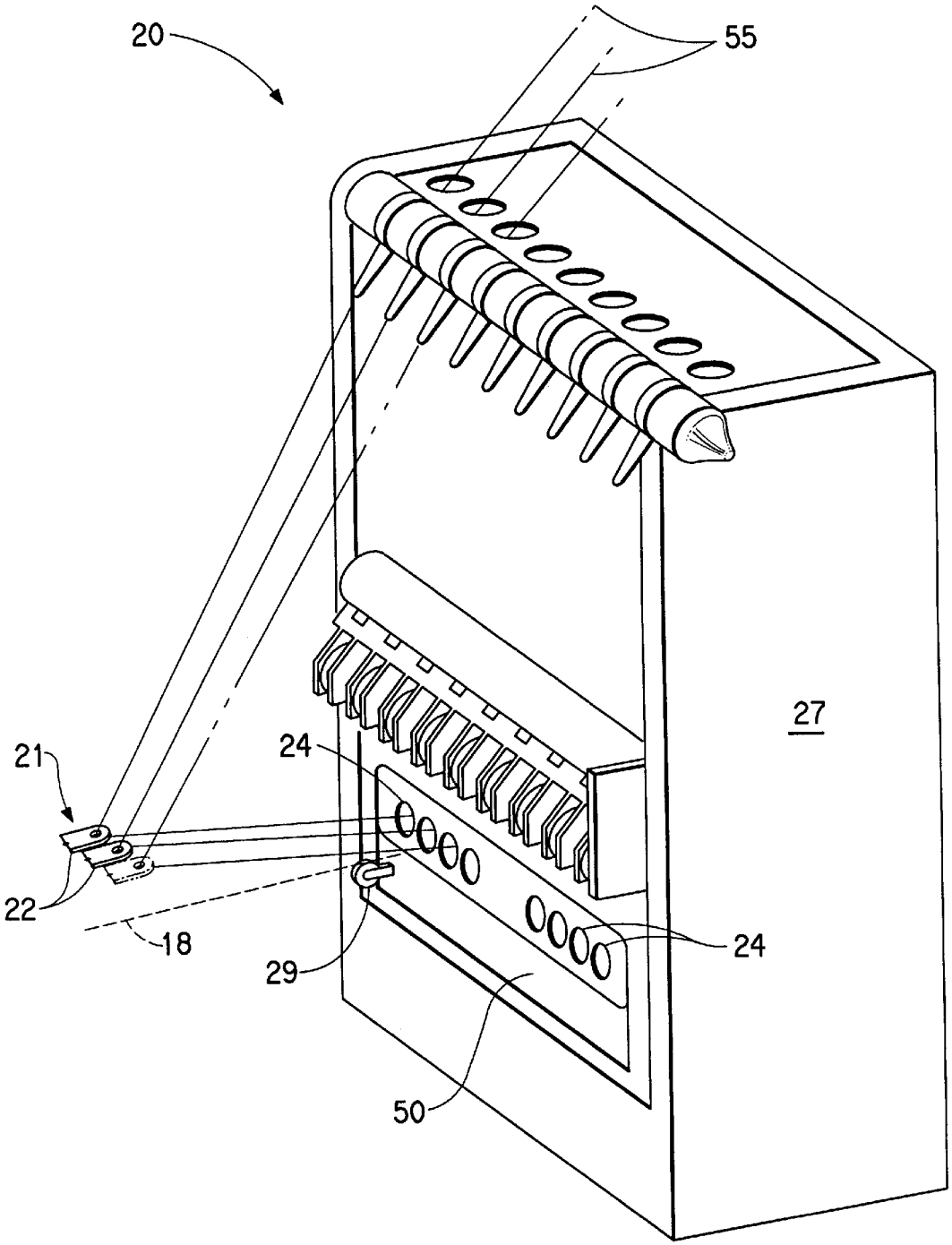
FIG. 14 is a perspective view of the tension device for the hard yarns on the knitting machine depicted in FIG. 1.

In lieu of guide wheels or pulleys, stationary polished ceramic or jewel surfaces can be used to guide and/or change the direction and/or angles of the bare elastomeric yarn. One embodiment of a stationary jewel guide is depicted in FIGS. 10–13. Yarn carrier tip 223 is hollowed as shown in FIGS. 10–13. Jewel ring 219, preferably a sapphire, is positioned within yarn carrier tip 223 as shown in FIGS. 12 and 13. To further reduce the contact points, and thus friction, along the elastomeric yarn, jewel ring 219 can be countersunk as shown in the cross-sectional view of FIG. 13 thereby leaving a contact point (internal diameter length) of 0.004 inches or less.

As can be appreciated, the foregoing stationary guides and wheels carry the spandex yarn therealong. More specifically, wherever the spandex yarn changes direction, including as it is being fed into the knitting needles, it is necessary to have a stationary low friction surface or rotatable wheel applied at that location so as to eliminate friction applied along the spandex yarn as much as possible.

In addition, using two yarn carriers (one for the hard yarn and one for the spandex), as shown in FIG. 3, or a single carrier which keeps the two yarns out of contact with each other eliminates a significant friction point. Ordinarily, a single standard plaiting carrier which carries both hard yarn and spandex is used. This type of carrier will produce substantial friction between the yarns as the yarns are being fed through the yarn carrier assembly and to the needles of the knitting machine because the yarns contact each other prior to being fed to the needles. The use of an individual carrier for the spandex yarn, as shown in FIG. 3, or a modified two yarn carrier which keeps the two yarns separate, completely eliminates inter-yarn friction. The individual carrier for the spandex yarn carrier additionally can be fitted with a separate wheel 40 to further minimize friction as much as possible.

Figure 4:
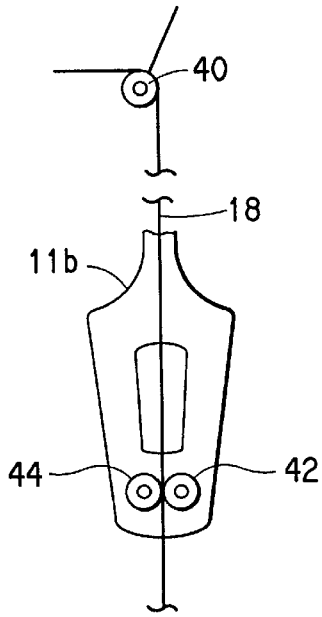
FIG. 4 is an enlarged side view of the elastomeric yarn carrier depicted in FIG. 3.
Figure 5:
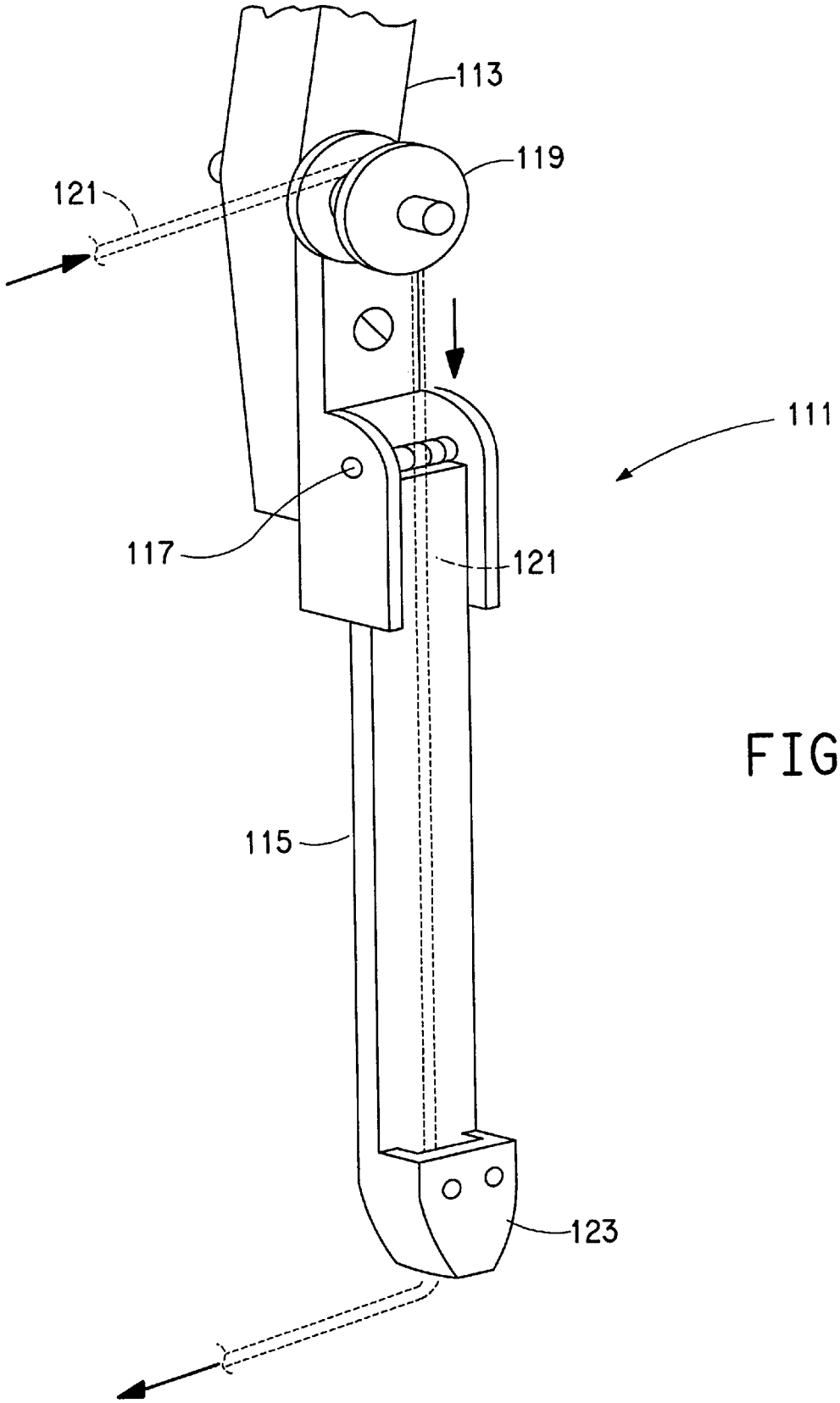
FIG. 5 is a perspective view illustrating a second embodiment of a yarn carrier assembly for practicing the invention.

As shown in FIG. 4. the yarn carrier for spandex yarn 18, also has rollers 42 and 44 mounted at its end. The spandex yarn is carried from roller 40 and then threaded between rollers 42 and 44 in order to minimize any change in tension when carrier 11 changes in speed while traveling from a forward feeding direction to a stop (left to right), and then again changes in speed when traveling in a backward feeding direction at course reversal (right to left).

Figure 15:
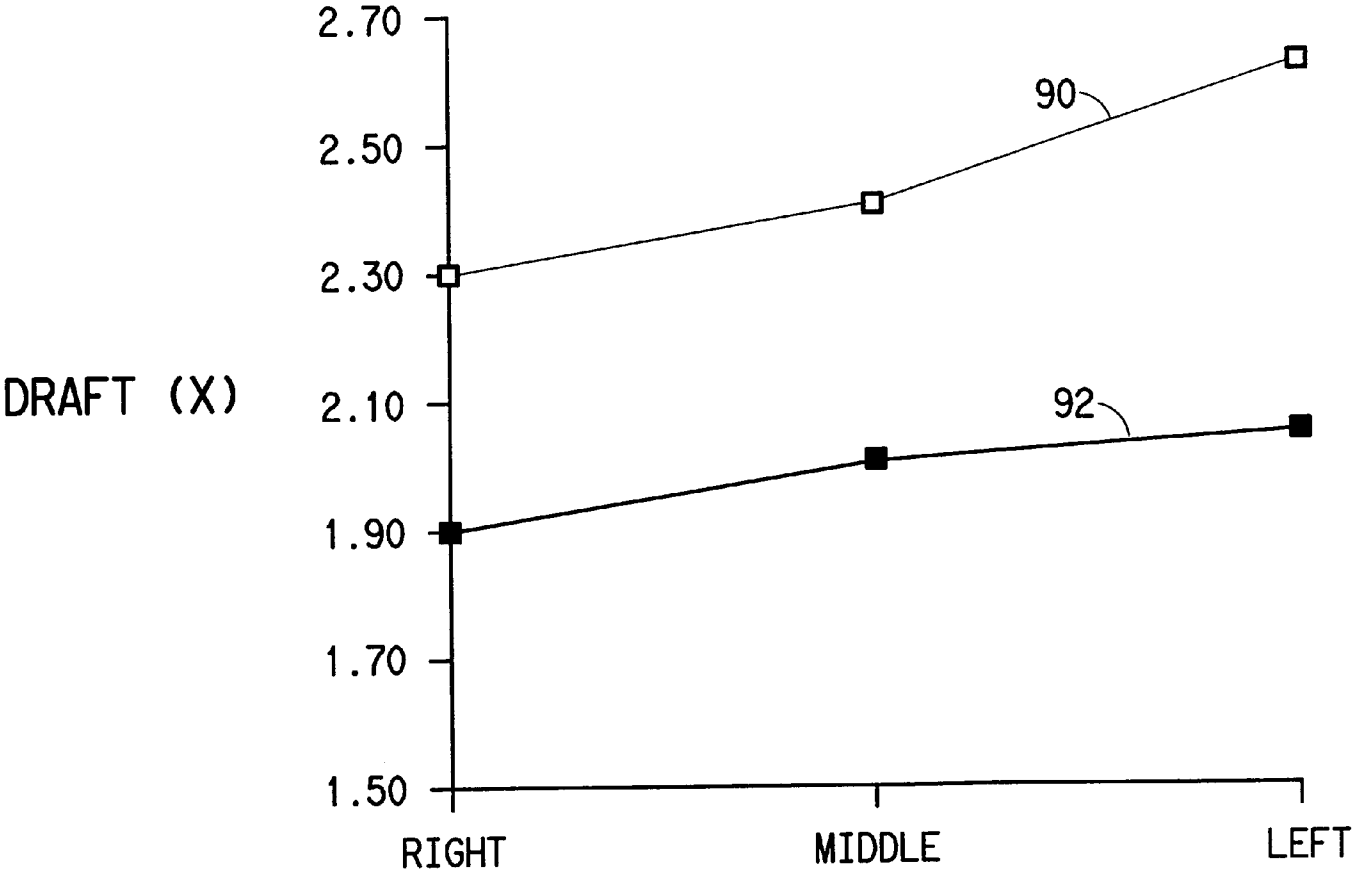
FIG. 15 is a plot of spandex draft versus location along a course in a knit fabric made according to this invention as compared to a fabric made according to the prior art.

To illustrate the present invention, coarse-cut sweater knits of modified rib/jersey construction were knit with Lycra® spandex Type 146-C (DuPont Company, Wilmington, Del., U.S.A.) and four ends of 300 denier continuous filament rayon. FIG. 15 is a graph of spandex draft versus position along a course in these sweater knits 92, versus a fabric knit according to the prior art 90. Aside from the low-friction modifications described herein, the knitting machine settings were identical. The graph clearly illustrates reduction and substantial uniformity in the draft of a product knit in accordance with the invention as compared to one knit in accordance with the prior art.

In an alternate embodiment, a second stand 16, spandex feeding device 14, and spandex yarn package 19 can be placed at the other side of knitting machine 10 in order to feed a second spandex yarn to the machine, alternating courses with the spandex supplied from the first stand. This requires use of an additional yarn carrier block (not shown) for the second spandex yarn 18.

In operation, the yarn carrier block for the first spandex yarn is carried in a first direction along the machine in order to knit a first course. Then, the yarn carrier block for the second spandex yarn is carried in the opposite direction in order to knit a second course. The first yarn carrier block is then carried in a reverse direction, and the same for the second yarn carrier block. Spandex supply for knitting is thus alternated course by course. As a result of such alternate side feeding, any residual non-uniformity in the elastomeric yarn draft along each course is balanced by an opposing non-uniformity in the next course. Thus, selvedge length differences of less than about 7% are achieved and unequal selvedge lengths are substantially avoided.

In testing, when a single spandex yarn and a hard yarn (rayon/spandex) were fed to the knitting machine fitted with low-friction guides, the fabric selvedge opposite the side from which the spandex was fed was on average 20% longer than the side closer to the spandex supply. The coefficient of variation (the measure of the amount of irregularity) of the selvedge length was on average 10.0%. When the spandex instead was fed at alternate courses from both sides of the machine, it was found that the fabric selvedge opposite the side from which the spandex was fed was ±2% longer/shorter than the side closer to the spandex supply. The coefficient of variation of the fabric length from side-to-side was 2%. This demonstrates that alternating elastomeric yarn supplied course-by-course is even more advantageous than just using the basic system.

Coarse cut sweaters knit in jersey construction were also manufactured from Lycra® spandex Type 146-C and two ends of 16/2 carded cotton. The number of spandex breaks per sample and the overall appearance of the fabrics (based on a 1 (poor) to 5 (excellent) rating) were determined. The spandex was fed from one side. The results are presented in Table 1 below.

TABLE 1

| SPANDEX FEED SYSTEM | BASIS WEIGHT OZ/YD2 | SPANDEX BREAKS | APPEARANCE RATING |
|---|---|---|---|
| No feeder | 21 | 26 | 1 |
| Feeder with high friction | 20 | 15 | 2 |
| Feeder with low friction | 15 | 0 | 5 |

Where no feeder was used, the spandex was led from a package on the stand plate, just as with the hard yarn. Where a feeder was used, the tension setting on the feeder was kept constant. As can be appreciated, when operating the feeder under low tension, the resulting fabric has a low fabric weight per unit area and fewer yarn breaks.

To further illustrate the present invention, single jersey sweater blanks of sweater knit fabric were knit on a Shima Model SES 122FF (Shima Seiki) flat-bed knitting machine so that the technical face was up. Except where noted, the machine speed was 0.75 meters/sec, and the yarn draw on each needle was 9.91 mm. Single system knitting (one course at a time) was used. Two yarn carriers, one for the spandex and one for the hard yarn, were used when the spandex was fed from one side of the machine. (Four yarn carriers were used when the spandex was alternately fed from both sides of the knitting machine.) The spandex was a single end of 40 denier (44 dtex) Lycra® Type 146C, and the hard yarn was four ends of 300 denier (330 dtex) rayon (Viscose #5330, Fabelta Industries, Ghent, Belgium) which had been package-dyed black. During single-side feeding, the spandex was fed from the right side of the machine through feeder, and the rayon was fed from the left side of the machine through a tension gate. The spandex was wrapped around the yarn reel on the spandex feeder about three or four times.

After knitting, the fabrics were washed with detergent at 70° F. for 16 minutes and drying at 135° F. for 40 minutes.

The sweater blanks were analyzed in several ways to give the results summarized in Table 2. Spandex content was calculated as the ratio of spandex denier (at the draft in the fabric) to total in-fabric yarn denier. Fabric weight was calculated from a 3-inch diameter punch. To evaluate the uniformity of the draft from course to course, the draft in a full course was calculated by removing the rayon and the spandex from that course and taking the ratio of the length of the rayon to that of the relaxed spandex. This was done at the top (T), center (C), and bottom (B) of the sweater blank. To evaluate the uniformity of the spandex draft along a course, a 10-cm width of fabric located 2 inches from the bottom (waistband) of the sweater blank was clamped, cut from the sweater blank, the rayon and spandex from one course removed, and the draft calculated as described above; this was removed, and the draft calculated as described above; this was done at the left (L), center (C), and right (R) of the sweater blank, about 5 cm up from the bottom of the sweater blank. To determine the uniformity of the overall dimensions of the sweater blanks, the selvedge lengths were measured.

The sweater blanks were also visually inspected on a black background, the sample numbers being concealed. They were rated for wale uniformity, stitch definition, and stitch uniformity on a scale of 1 (poor) to 5 (excellent). The results are reported in Table 2. After each number, – and + indicate that the averages of three independent ratings were less than or greater than the reported number.

During knitting, measurements were made of the tension experienced by the spandex as it left the feeder by passing the spandex through a tensiometer (part no. 006.100.061, Memminger-Iro GmbH, Dornstetter, Germany) and sending the tensiometer output signal to an Autoranging 100 MHz Tekscope (Tektronix, Wilsonville, Oreg.) for viewing. The tensiometer was the same head normally supplied by Memminger-Iro GmbH with the Model EFS 70 spandex feeder. Copies of the traces were printed from the Tekscope with a DUP-411 Type II Thermal Printer (Seiko Instruments, Chiba, Japan). The maximum tension in grams (g) and grams per denier (gpd), Steady State tension in grams (g) and Maximum minus Steady State tension in g and gpd were measured. Here, "Maximum" is the maximum tension applied to the spandex as the carrier accelerates away from the feeder. "Steady State" is the roughly constant tension achieved after the carrier is up to speed and moving away from the feeder. "Maximum minus Steady State" is the difference between the "Maximum" and "Steady State" tensions and is a measure of the uniformity of the tension applied to the spandex at the selvedge closest to the feeder compared to the rest of the fabric. The greater the difference between "Maximum" and "Steady State" tensions, the larger the tension spike as the yarn carrier accelerates.

EXAMPLE 1

Comparative Example

The spandex delivery system in this example included a spandex feeder Model EFS 31 (Memminger-Iro GmbH, Dornstetter, Germany) which had been modified by replacing the fixed ceramic guide "output eyelet" at the exit of the feeder with a rolling guide about 0.5 in. outer diameter; the feeder tensiometer was set at 0. (Spandex feeder Model EFS 31 is similar to the feeder of FIG. 2 with the following important differences. In place of spandex yarn guide 30 and guide roller 36, Model EFS 31 is equipped, respectively, with a post-and-disc tensioner and a grooved eyelet, and instead of yarn 18 traveling freely from guide roller 36 to the yarn carrier assembly, the yarn exiting Model EFS 31 passes through a fixed ceramic guide "output eyelet".) In the knitting machine, a fixed guide was used at the "eye-board" entrance (the position of rolling guide 29 in FIG. 14) to the knitting machine. A second 0.5 in. diameter rolling guide was placed at the top of the spandex carrier (the same position as rolling guide 40 in FIG. 3) to guide the spandex around the 90° bend and down to the yarn carrier tip finger (at the bottom of the yarn carrier) and the knitting needles; the customary fixed steel guides were at the yarn carrier tip finger. The tension on the post-and-disc tensioner at the inlet to the feeder was set as low as possible. The tension measurements for this system were:

| | |
|---|---|
| Maximum, g | 5.2 |
| gpd | 0.13 |
| Steady State, g | 4.0 +/−0.8 (+/−20%) |
| Maximum minus | |
| Steady State, g | 1.2 |
| gpd | 0.030 |

EXAMPLES IIa AND IIb

The spandex delivery system in these examples included the spandex feeder depicted in FIG. 2 wherein a Model EFS 31 feeder such as that used in Example I was modified by removing the post-and-disc tensioner, replacing the fixed guide on the yarn control arm with a rolling guide having an outer diameter of about 0.33 in. and mounted on jeweled bearings, and removing the fixed guide output eyelet entirely. The feeder tensiometer was set at 0.5. In the knitting machine, a rolling guide of about 0.5 in. diameter was placed at the eye-board, and a Delrin® acetal resin (DuPont Company, Wilmington, Del., U.S.A.) wheel having a jeweled bearing was placed at the top of the spandex yarn carrier. In addition, the fixed guides at the yarn carrier tip finger were replaced by two small (0.045 in. outer diameter) rollers on jeweled bearings such as depicted in FIGS. 4–7 so that the spandex rode on the rollers both when the carrier was moving away from and returning toward the spandex feeder.

In Example IIa, the spandex was fed from the right side of the machine via an EFS 31 feeder modified as described above. In Example IIb, the spandex was fed into alternate courses via two modified EFS 31 feeders from both sides of the knitting machine. The tension measurements for the feeder of Examples IIa and IIb were:

| | |
|---|---|
| Maximum, g | 3.4 |
| gpd | 0.08 |
| Steady State, g | 2.4 +/−0.1 (+/−4%) |
| Maximum minus | |
| Steady State, g | 1.0 |
| gpd | 0.025 |

EXAMPLES IIIa AND IIIb

In Examples IIIa and IIIb, the spandex delivery system included an EFS 70 spandex feeder (Memminger-Iro GmbH) in place of the modified EFS 31 feeder. (Using the EFS 70 feeder, the spandex yarn traveled from an overhead bobbin, down through a yarn input eyelet, around a storage reel (similar to reel 32 of FIG. 2), through a first pair of guide pulleys, through a piezoelectric tension sensing device and finally over a Delrin® acetal resin wheel having jeweled bearings which was located at the feeder exit. At the storage reel the yarns traveled around the reel a few times, then exited at an angle of about 90° from the path on which the yarn traveled toward the reel.) The feeder tensiometer was set at 4. The rest of the system was the same as in Example IIa. In Example IIIa, the knitting was done at a machine speed of 0.75 m/sec, and In Example IIIb, the machine speed was 1.1 m/sec. The tension measurements for the feeder of Examples IIIa and IIIb were:

| | |
|---|---|
| Maximum, g | 2.5 |
| gpd | 0.06 |
| Steady State, g | 2.1 +/−0.1 (+/−5%) |
| Maximum minus | |
| Steady State, g | 0.4 |
| gpd | 0.010 |

TABLE 2

| Each datum is based on three measurements on each of three samples | | | | | |
|---|---|---|---|---|---|
| EXAMPLE: | I | IIa | IIb | IIIa | IIIb |
| Spandex content, wt % | 1.5% | 1.9% | 1.9% | 1.9% | 1.9% |
| Fabric weight, oz/yd2 | 17 | 12 | 12 | 11 | 12 |
| Full width draft (measured at the top, center, bottom) | | | | | |
| Average | 2.0 | 1.6 | 1.6 | 1.6 | 1.7 |
| Range in avg., top vs center vs bottom | 1.99–2.06 | 1.61–1.62 | 1.63–1.66 | 1.63–1.66 | 1.65–1.67 |
| Max. difference, single sample Left/center/Right draft | 10% | 8% | 4% | 4% | 2% |
| Avg. % diff., R/L Selvedge lengths, Left/Right difference | 12% | 5% | 0% | −1 | −1% |
| Avg. % diff, L/R | 10% | 10% | −1% | 2% | 2% |
| Range | 9–12% | 8–12% | −2–1% | 0–3% | 1–3% |

TABLE 2-continued

| Each datum is based on three measurements on each of three samples | | | | | |
|---|---|---|---|---|---|
| EXAMPLE: | I | IIa | IIb | IIIa | IIIb |
| Avg. diff, L–R, in. | 1.9" | 2.7" | −0.2" | 0.4" | 0.6" |
| Visual Uniformity Rating | 1 | 3 | 3− | 4 | 4+ |

The spandex in the fabric of Examples IIa, IIb, IIIa and IIIb has a lower and more uniform draft, both within a course and from course to course, than the fabric of Comparative Example I. In the preferred fabric of Examples IIb, IIIa and IIIb, the selvedge lengths are also more uniform. The uniformity of the fabrics of the invention is clearly superior to that of the comparative Example.

Figure 16:
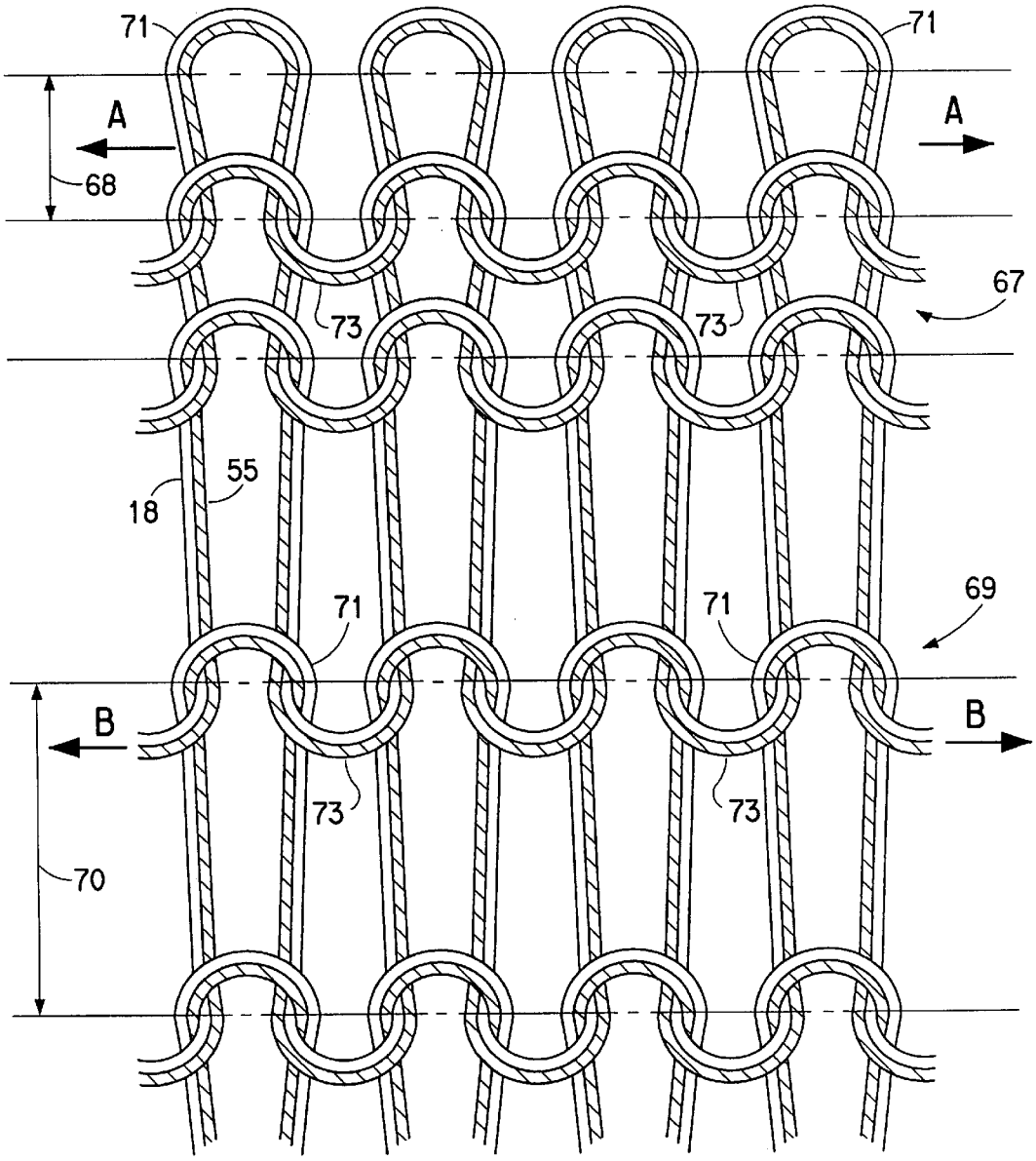
FIG. 16 is a plan view of the technical reverse side of a fabric piece made in accordance with the invention.

FIG. 16 is a view of the technical reverse side of a piece of fabric made in accordance with the invention. As shown in FIG. 16, the hard yarn 55 and elastomeric yearn 18 are plaited together in a knit construction with the hard yarn being visible from the technical face and the spandex being only visible from the technical back. In this example, the fabric has two portions 67 and 69 defined by courses 68 and 70 respectively, each portion having a different stitch size.

As can be appreciated, the sweater knit fabric shown in FIG. 16 has a plurality of needle loops 71 and sinker loops 73 which are substantially uniform in size and shape in each fabric portion. The vertical wales and horizontal courses are substantially identical in appearance as well.

The spandex will have substantially uniform draft in successive courses and in both fabric portions 67 and 69. As a result, the fabric in both sections will have substantially uniform stretch (across A—A and B—B) and recovery in all directions.

Preferably, the draft of the spandex will be between 1.1 and 4.5 and more preferably between 1.2 and 2.5. The denier of the spandex will be between 10 and 150 and more preferably between 10 and 70.

The product produced by the inventive method integrates bare spandex or some other elastomeric yarn with a hard yarn in a plaited knit construction in order to produce a dimensionally uniform sweater knit fabric. The fabric will exhibit minimal distortion and increased consistency in size from piece to piece.

According to the prior art, the tension on spandex yarn increases with the length or size of the loops being knit. As a result, the draft of the spandex will increase as well. In contrast, in the inventive fabric, the draft is maintained at a pre-determined and substantially constant level regardless of the loop size. This is because the method of the invention enables precise change in the rate of spandex delivery to the knitting machine notwithstanding the speed of the machine or the size or structure of the loops being knit. Thus, spandex is supplied at a constant elongation or draft.

Moreover, because spandex draft is maintained substantially constant, the tactile effect on the fabric is substantially uniform—the spandex yarn will cause the fabric loops to push out uniformly from the plane of the fabric such that the hard yarn fibers extend uniformly. Therefore, the entire fabric surface maintains a substantially soft uniform feel. It will thus be seen that the objects set forth above, among those made apparent from the preceding description, and efficiently attained, and since certain changes may be made in the above product and system without departing from the spirit and scope of the invention, it is intended that all matter contained in the above description and shown in accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A sweater knit fabric comprising:

at least one hard yarn and at least one bare elastomeric yarn, the yarns being plaited together into a sweater knit fabric, wherein the elastomeric yarn has substantially uniform draft (elongation) along each course in the fabric.

2. The sweater knit fabric of claim 1, wherein the elastomeric yarn has substantially uniform draft in successive courses in the fabric.

3. The sweater knit fabric of claim 2, wherein said draft is between about 1.1 and 4.5.

4. The sweater knit fabric of claim 3, wherein said draft is between about 1.2 and 2.5.

5. The sweater knit fabric of claim 1, wherein the denier of the elastomeric yarn is between about 10 and 150.

6. The sweater knit fabric of claim 5, wherein the denier of the elastomeric yarn is between about 10 and 70.

7. The sweater knit fabric of claim 1, wherein the fabric is a flat knit fabric.

8. The sweater knit fabric of claim 1, wherein the fabric is a circular knit fabric.

9. The sweater knit fabric of claim 1, wherein the bare elastomeric yarn is bare spandex.

10. The sweater knit fabric of claim 1, wherein the selvedge length difference in the fabric is less than about 7%.

11. A method for constructing a sweater knit fabric comprising:

delivering at least one bare elastomeric yarn and at least one hard yarn to a common location for knitting;

knitting together the two yarns in a plaited formation in order to produce a sweater knit fabric;

selecting a desired level of tension for the elastomeric yarn as the yarn is delivered for knitting; and maintaining said desired tension level substantially constant during said knitting such that the tension of the elastomeric yarn during steady state knitting varies no more than 17% from the average total steady state tension of said yarn.

12. The method of claim 11, wherein during the maintaining step the tension of the elastomeric yarn during steady state knitting varies by no more than 10% from the average total steady state tension of said yarn.

13. The method of claim 11, wherein the maintaining step comprises:

sensing momentary variation in demand for the elastomeric yarn during said knitting step; and in response to said sensing step, selectively controlling the variation in tension level of said elastomeric yarn as said level tries to vary from said desired tension level in response to yarn demand variations during knitting.

14. The method of claim 11, wherein said selecting step comprises changing said desired tension level during said knitting step.

15. The method of claim 11, wherein the knitting step comprises knitting the two yarns together in a flat knit fabric.

16. The method of claim 11, wherein the knitting step comprises knitting the two yarns together in a circular knit fabric.

17. The method of claim 11, wherein the delivering step comprises feeding the bare elastomeric yarn to said common location in alternating courses from opposite directions.

18. A system for constructing sweater knit fabrics by plaiting together at least one hard yarn and at least one bare elastomeric yarn comprising:

means for knitting together at least one elastomeric yarn and at least one hard yarn in a plaited formation in order to produce a sweater knit fabric;

means for delivering said elastomeric yarn to said knitting means;

means for delivering said hard yarn to the knitting means;

means for selecting a desired level of tension for the elastomeric yarn as the yarn is delivered to said knitting means; and means for maintaining said desired tension level substantially constant during knitting such that the tension of the elastomeric yarn during steady state knitting varies by no more than 17% from the average total steady state tension of said yarn.

19. The system of claim 18, wherein the maintaining means maintains the tension of the elastomeric yarn during steady state knitting at a level which varies no more than 10% from the average total steady state tension of said yarn.

20. The system of claim 18, wherein the maintaining means comprises:

means for sensing momentary variations in demand for the elastomeric yarn by said knitting means; and means responsive to said sensing means for controlling any variation in tension level of said elastomeric yarn as said tension level tries to vary from said desired tension level in response to variations in yarn demand.

21. The system of claim 20, wherein the sensing means comprises a control arm movable between a first position and a second position in response to changes in demand for said elastomeric yarn by said knitting means.

22. The system of claim 20 wherein the sensing means comprises a strain gauge device.

23. The system of claim 20, wherein the maintaining means further comprises wheel means for carrying said elastomeric yarn as said yarn is delivered to said knitting means and being provided at locations where said elastomeric yarn substantially changes direction.

24. The system of claim 23, wherein said wheel means comprises wheels riding within jewel bearings.

25. The system of claim 20, wherein the maintaining means further comprises guide means for guiding said elastomeric yarn as said yarn is delivered to said knitting means, said guide means comprising a low friction surface and being provided at locations where said elastomeric yarn substantially changes direction.

26. The system of claim 25, wherein the low friction surface comprises a sapphire jewel.

27. The system of claim 18, wherein said knitting means comprises a flat bed knitting machine including transport means for selectively traveling between one side of said knitting machine and the other side of said knitting machine in order to knit said fabric.

28. The system of claim 18, wherein said knitting means is a circular knitting machine.

29. The system of claim 18, wherein said elastomeric yarn delivery means includes means for feeding said elastomeric yarn to said knitting means in alternating courses from yarn supply means located at either end of said knitter.

* * * * *

UNITED STATES PATENT AND TRADEMARK OFFICE

CERTIFICATE OF CORRECTION

PATENT NO. : 5,931,023
DATED : August 3, 1999
INVENTOR(S) : Ernesto Brach, et. al.

It is certified that error appears in the above-identified patent and that said Letters Patent is hereby corrected as shown below:

Title page, item [73], Assignee: should read -- "E. I. du Pont de Nemours and Company --.

Signed and Sealed this

Fourth Day of July, 2000

*Attest:*

*Attesting Officer*

Q. TODD DICKINSON

*Director of Patents and Trademarks*